US006394756B1

(12) United States Patent
Bucher et al.

(10) Patent No.: US 6,394,756 B1
(45) Date of Patent: May 28, 2002

(54) DECORATIVE COVER FOR A CEILING FAN SUSPENSION ROD

(75) Inventors: John C. Bucher, Ft. Lauderdale; Charles E. Bucher, Valrico, both of FL (US)

(73) Assignee: King of Fans, Inc.

( * ) Notice: Subject to any disclaimer, the term of this patent is extended or adjusted under 35 U.S.C. 154(b) by 0 days.

(21) Appl. No.: 09/560,210

(22) Filed: Apr. 28, 2000

(51) Int. Cl.[7] ..... F04D 29/64
(52) U.S. Cl. ..... 416/244 R; 416/5; 416/146 R
(58) Field of Search ..... 416/5, 146 R, 416/244 R, 246; 362/96, 294; D23/377, 379, 385, 411; 248/345, 345.1

(56) References Cited

U.S. PATENT DOCUMENTS 636,871 A * 11/1899 Wait ..... 416/5
763,237 A * 6/1904 Young ..... 248/345
1,385,192 A * 7/1921 Sprecher ..... 248/345
4,402,649 A * 9/1983 Laurel ..... 416/5
4,884,947 A * 12/1989 Rezek ..... 416/5

* cited by examiner

*Primary Examiner*—Christopher Verdier
(74) *Attorney, Agent, or Firm*—Holland & Knight LLP

(57) ABSTRACT

A suspension rod is adapted to connect a ceiling fan to a ceiling bracket that is used to suspend the ceiling fan from a ceiling, and includes a ball portion, an elongated tubular portion, and a sheath member. The ball portion is adapted to be secured to the ceiling bracket. The elongated tubular portion is adapted to permit electrical cables to pass therethrough for providing electricity to a motor of the ceiling fan, and includes an upper end integrally formed with or rigidly connected to the ball portion, a lower end distal to the ball portion and adapted to be inserted into a central hole in an upper major wall of a motor casing, and an intermediate portion that is disposed between the upper end and the lower end, and that has an outer diameter which is smaller than the central hole in size. The sheath member is disposed to surround and extend along the entire length of the intermediate portion, thereby enabling a display of color, shape or texture different from that of the intermediate portion.

1 Claim, 4 Drawing Sheets

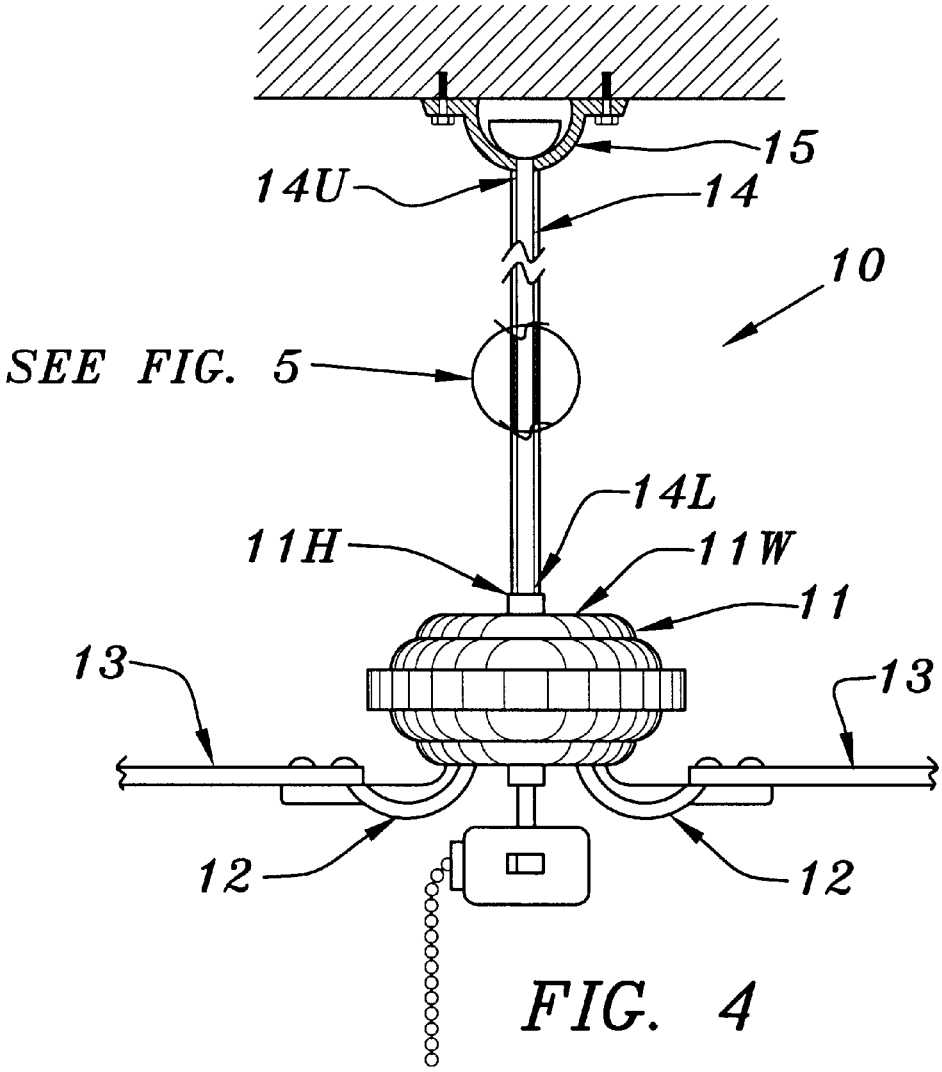
FIG. 4
FIG. 5
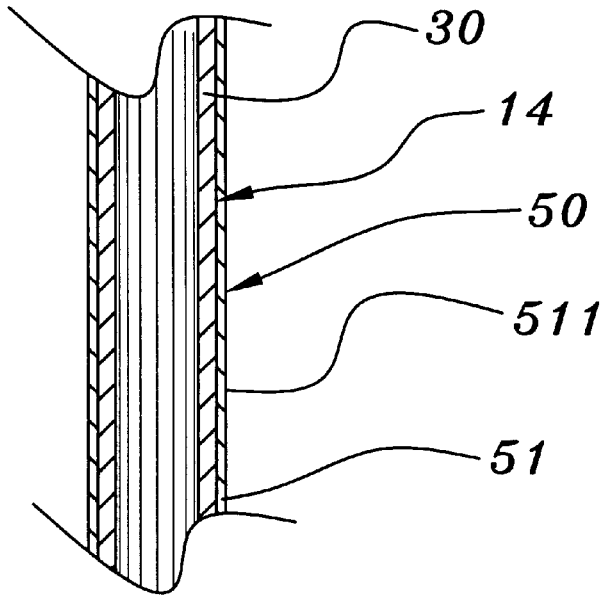

DECORATIVE COVER FOR A CEILING FAN SUSPENSION ROD

BACKGROUND OF THE INVENTION

1. Field of the Invention

The present invention relates to a suspension rod adapted to connect a ceiling fan to a ceiling bracket that is used to suspend the ceiling fan from a ceiling. More particularly, this invention relates to a suspension rod provided with a sheath member to enable the suspension rod to match the color, shape or texture of the ceiling fan.

2. Description of the Background Art

Nowadays, ceiling fans are not merely used to produce a current of air, they are also endowed with an ornamental function. As such, the color, shape and texture of a ceiling fan is generally selected so as to highlight the ornamental effect thereof.

Referring to FIG. 1, a conventional ceiling fan 10 is shown to include a motor casing 11 in which a motor (not shown) is mounted, a plurality of fan blade brackets 12 mounted on a bottom portion of the motor, a plurality of fan blades 13 mounted to the fan blade brackets 12, and a suspension rod 14 (sometimes referred to as a down-rod) that extends from a top portion of the motor casing 11 and that is adapted to permit electrical cables to pass therethrough for supplying electricity to the motor. The motor casing 11 has an upper major wall 11W defining a central hole 11H of a first dimension. The central hole 11H extends in an axial direction and communicates the upper major wall 11W with the motor. The suspension rod 14 has an upper end 14U connected to a ceiling bracket 15 that is used to suspend the ceiling fan 10 from a ceiling, and a lower end 14L inserted into the central hole 11H in the motor casing 11.

In general, the standard length of the suspension rod 14 is 6". In places where the ceiling is high such as a cathedral ceiling, a ceiling fan with a 6" suspension rod cannot provide the desired ventilating effect or clearance. Therefore, there are available on the market 12-inch (or longer) extended suspension rods 14. With reference to FIG. 2, an extended suspension rod 14 replaces the standard-length suspension rod 14.

As the surface of the suspension rod 14 usually has a metallic color of bronze or silver with a circular cross-sectional configuration, it may not match the color, shape (e.g., multi-faceted appearance) or texture (e.g., wood-grain textured appearance) of the ceiling fan 10, and may impair the ornamental aspect of the ceiling fan 10.

Therefore, it is an object of this invention to provide an apparatus which overcomes the aforementioned inadequacies of the prior art devices and provides an improvement which is a significant contribution to the advancement of the ceiling fan suspension rod art.

Another object of this invention is to provide a ceiling fan suspension rod adapted to connect a ceiling fan to a ceiling bracket that is used to suspend the ceiling fan from a ceiling, and provided with a sheath member to enhance the ornamental aspect of the ceiling fan.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a ceiling fan suspension rod adapted to connect a ceiling fan to a ceiling bracket that is used to suspend the ceiling fan from a ceiling, and provided with a sheath member to enhance the ornamental aspect of the ceiling fan.

More particularly, a typical ceiling fan includes a motor, a motor casing, and a plurality of fan blades. The motor casing is disposed to enclose the motor therein, and has an upper major wall defining a central hole of a first dimension. The central hole extends in an axial direction and communicates the upper major wall with the motor. The fan blades are disposed to be distal to the upper major wall in the axial direction, and to be driven by the motor to rotate relative to the motor casing.

According to the present invention, the suspension rod includes a ball portion, an elongated tubular portion, and a sheath member. The ball portion is adapted to be fitted into a socket portion of the ceiling bracket. The elongated tubular portion is adapted to permit electrical cables to pass therethrough for providing electricity to the motor, and includes an upper end, a lower end, and an intermediate portion. The upper end is integrally formed with or rigidly connected to the ball portion. The lower end is distal to the ball portion and is adapted to be inserted into and rigidly secured to the central hole in the motor casing. The intermediate portion is disposed between the upper end and the lower end, and has an outer diameter of a second dimension that is smaller than the first dimension. The sheath member is disposed to surround and extend along the length of the intermediate portion, thereby enabling a display of color, shape or texture different from that of the intermediate portion so as to be the same color, shape or texture or an aesthetically-pleasing coordinated color, shape or texture of the ceiling fan. In this manner, the sheath member may include many different colors, shapes and textures, or combinations thereof, as may be desirable to be aesthetically coordinated with the particular ceiling fan. For example, the sheath may comprise a brown color with a wood-grain texture and a multi-faceted cross-sectional shape that is more coordinated (than prior art metallic suspension rods) with a corresponding brown ceiling fan having a multi-faceted wood-grain appearance.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 4 is a sectional view of the first preferred embodiment after assembly;

FIG. 5 is an enlarged view of an encircled portion in FIG. 4;

Similar reference characters refer to similar parts throughout the several views of the drawings.

DETAILED DESCRIPTION OF THE PREFERRED EMBODIMENT

Figure 2:
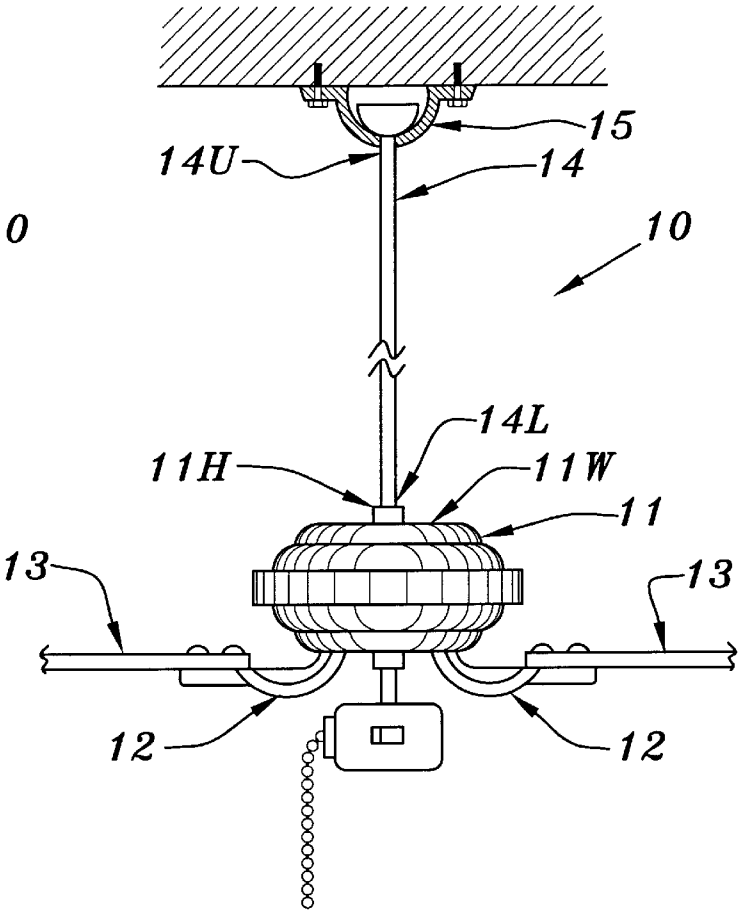
FIG. 2 Prior Art
FIG. 2 is an assembled schematic view of a conventional ceiling fan with an extended suspension rod mounted to a ceiling.
Figure 1:
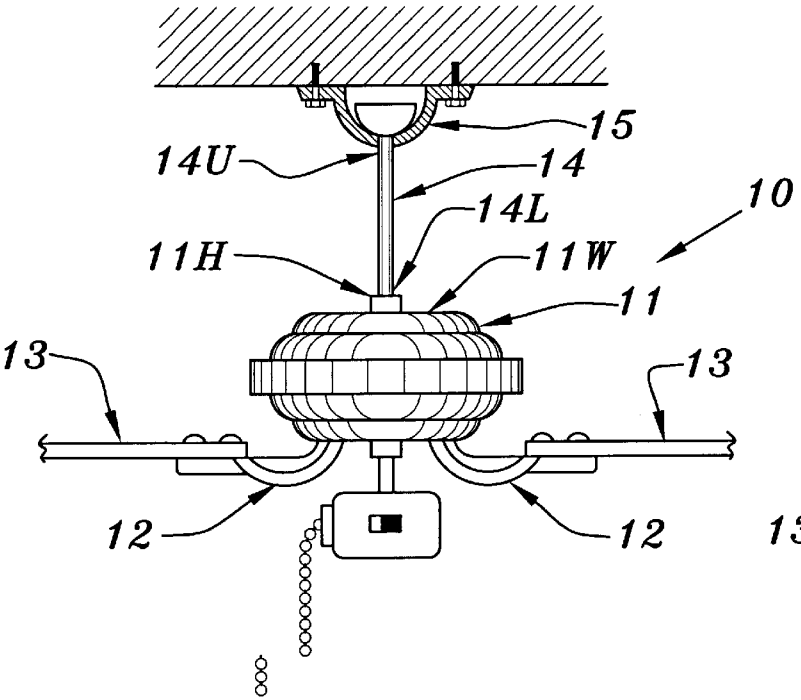
FIG. 1 Prior Art
FIG. 1 is an assembled schematic view of a conventional ceiling fan with a standard suspension rod suspended to a ceiling.
Figure 3:
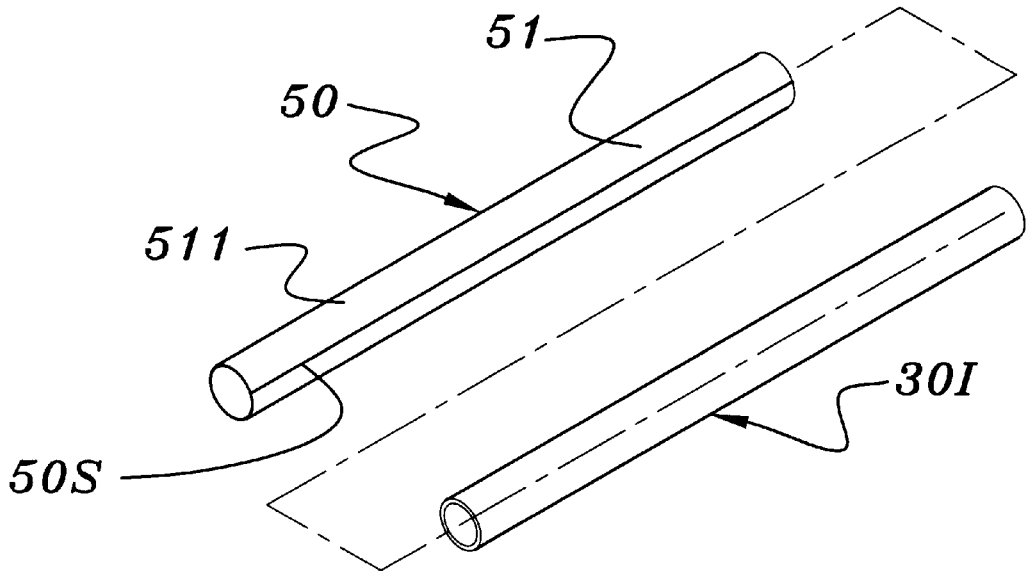
FIG. 3 is an exploded perspective view of the first preferred embodiment of a suspension rod according to the present invention wherein the sheath member has a circular cross-sectional configuration coinciding with the circular cross-sectional configuration of the suspension rod and FIG. 3A is an exploded perspective view of the suspension rod wherein the sheath member has a multi-faceted cross-sectional configuration that serves the function of changing the apparent shape of the circular cross-sectional configuration of the suspension rod.
Figure 3A:
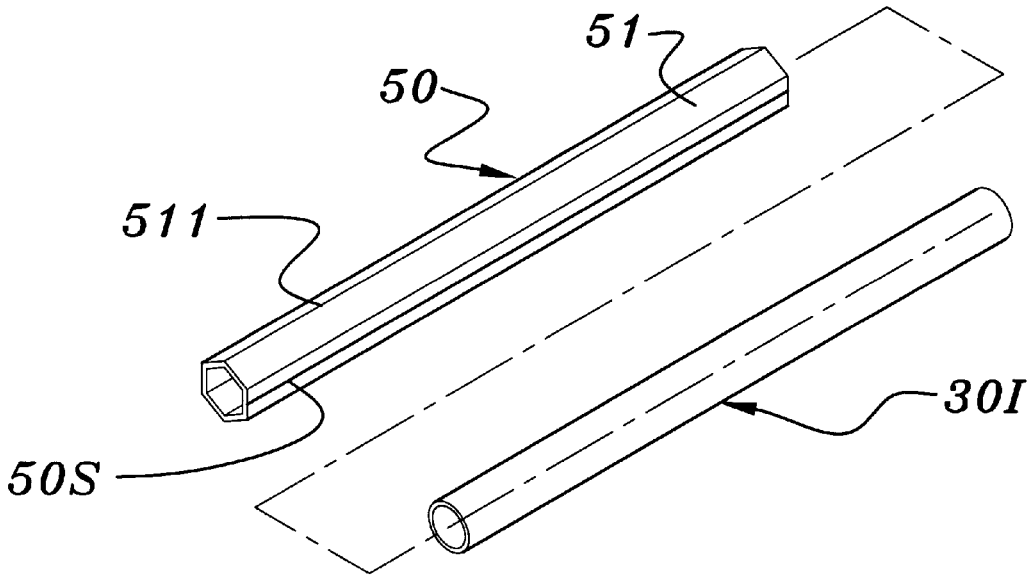

Referring to FIGS. 3 to 5, the first preferred embodiment of the suspension rod 14 according to the present invention is adapted to be connected to a conventional ceiling fan 10. As shown, the suspension rod 14 includes a ball portion 14B adapted to be secured to a ceiling bracket 15, and an elongated tubular portion 30 adapted to permit electrical cables to pass therethrough. The tubular portion 30 includes an upper end 30U, a lower end 30L, and an intermediate portion 30I. The upper end 30U is integrally formed with or rigidly connected to the ball portion 14B. The lower end 30L is distal to the ball portion 14B and is adapted to be inserted into the central hole 11H in the upper major wall 11W of the motor casing 11. The intermediate portion 30I is disposed between the upper end 30U and the lower end 30L, and has an outer diameter of a second dimension that is smaller than the first dimension of the central hole 11H in the motor casing 11. The suspension rod 14 further has a sheath member 50 that is disposed to surround, and extend along the length of the intermediate portion 30I of the tubular portion 30, thereby enabling the intermediate portion 30I to display a different color, shape or texture. The sheath member 50 may comprise various colors, shapes and textures, or various combinations thereof, as may be desirable to be aesthetically coordinated with the ceiling fan 10.

In this embodiment, the sheath member 50 is a thin sleeve 51 (having a thickness of about 1 mm) formed from rubber or plastics. The sleeve 51 has a length substantially the same as that of the tubular portion 30, and a surface 511 that has the same color, shape or texture or an esthetically-pleasing coordinated color, shape or texture as the ceiling fan 10. Further, the sheath member 50 has an inner diameter slightly greater than the outer diameter of the tubular portion 30 such that it can be sleeved onto the outside of the tubular portion 30 to enable the latter to display the same color, shape or texture or an esthetically-pleasing coordinated color, shape or texture as the ceiling fan 10. Sheath member 50 may include a longitudinal slit 50S allowing it to be spread apart along the slit 50S during assembly and fitted over the tubular portion 30 instead of having to be sleeved over the end of the tubular member 30.

Figure 6:
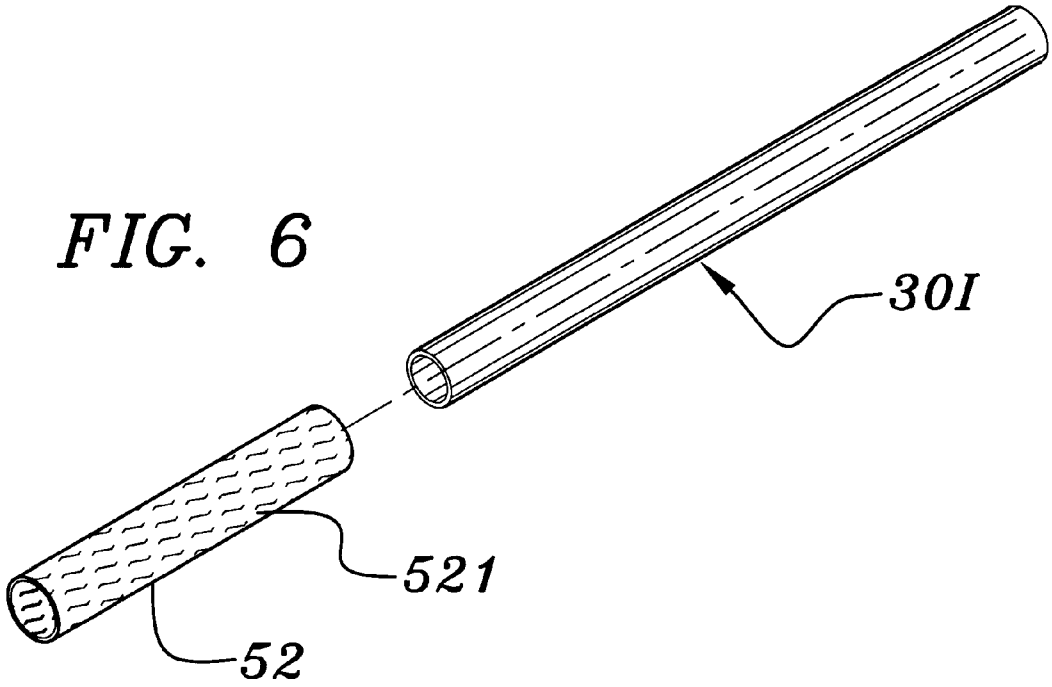
FIG. 6 is an exploded perspective view of the second preferred embodiment of the suspension rod according to the present invention.

With reference to FIG. 6, the sheath member 50 may be in the form of a thermo-plastic film 52 that has a surface 521 of the same color, shape or texture or an asthetically-pleasing coordinated color, shape or texture as the ceiling fan 10, and that can be sleeved onto the tubular portion 30. A heat gun or blow dryer can be utilized to heat the thermo-plastic film 52 to cause it to adhere to the tubular portion 30 so that the tubular portion 30 displays the same color, shape or texture or an asthetically-pleasing coordinated color, shape or texture as the ceiling fan 10. In addition, the thermo-plastic film 52 can be folded to save packaging space.

Figure 7:
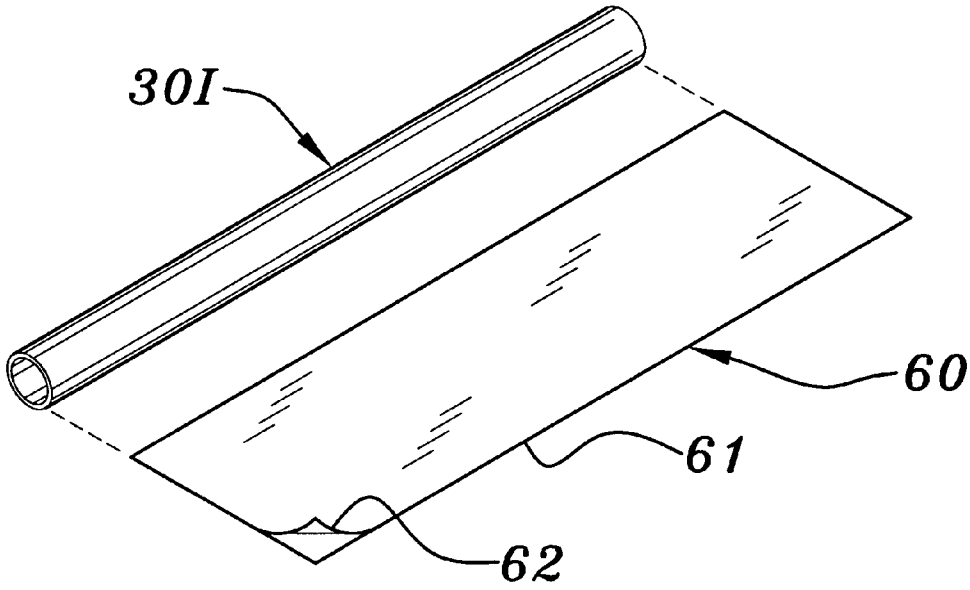
FIG. 7 is an exploded perspective view of the third preferred embodiment of the suspension rod according to the present invention.

With reference to FIG. 7, the sheath member 50 may be in the form of a flexible sheet 60. The sheet 60 has an outer surface 61 of the same color, shape or texture or an esthetically-pleasing coordinated color, shape or texture as the ceiling fan 10, and an inner side to which an adhesive and a release paper 62 are applied. In use, the release paper 62 is removed, and the inner side of the sheet 60 is adhered to the tubular portion 30I to enable the latter to display the same color, shape or texture or an esthetically-pleasing coordinated color, shape or texture as the ceiling fan 10.

A major advantage of the present invention is that if the user finds the standard 6-inch suspension rod packed with the ceiling fan 10 too short for his high ceiling and has to purchase a 12-inch extension rod, which may have a color, shape or texture different from that of the ceiling fan, he can utilize the sheath member of the present invention to make the extension rod match the color, shape or texture of the ceiling fan in a very easy and convenient way, thereby maintaining the ornamental aspect of the ceiling fan.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described,

What is claimed is:

1. A ceiling fan for suspension from a ceiling bracket which is used to suspend the ceiling fan from a ceiling, the ceiling fan comprising in combination:

a motor and a motor casing a plurality of fan blades operatively connected to the motor to rotate;

a suspension rod for interconnecting the ceiling bracket and the motor casing, the suspension rod including an elongated tubular portion; and a sheath member disposed to surround and extend along at least a portion of the length of the elongated tubular portion, said sheath member comprising a sleeve having a slit configuration that is spread apart and inserted over the elongated tubular portion during assembly, thereby enabling a display of various colors, shapes or textures.

* * * * *